US007461505B2

(12) United States Patent
Nakagawa

(10) Patent No.: US 7,461,505 B2
(45) Date of Patent: Dec. 9, 2008

(54) EXHAUST PIPE OF VEHICLE

(75) Inventor: Yukihiro Nakagawa, Kasugai (JP)

(73) Assignee: Nakagawa Sangyo Co., Ltd., Nishikasugai-gun (JP)

( * ) Notice: Subject to any disclaimer, the term of this patent is extended or adjusted under 35 U.S.C. 154(b) by 12 days.

(21) Appl. No.: 11/404,783

(22) Filed: Apr. 17, 2006

(65) Prior Publication Data

US 2006/0191259 A1 Aug. 31, 2006

(51) Int. Cl.
*F01N 3/10* (2006.01)

(52) U.S. Cl. ..... 60/299; 60/300; 60/302; 60/324; 422/169; 422/176; 422/179

(58) Field of Classification Search ..... 60/299, 60/300, 302, 322, 324; 422/169, 170, 176, 422/179, 180, 219
See application file for complete search history.

(56) References Cited

U.S. PATENT DOCUMENTS

| | | | | |
|---|---|---|---|---|
| 3,523,590 | A * | 8/1970 | Straw | 181/282 |
| 5,118,476 | A * | 6/1992 | Dryer et al. | 422/179 |
| 5,220,789 | A * | 6/1993 | Riley et al. | 60/302 |
| 6,185,819 | B1 * | 2/2001 | Bauer et al. | 29/890 |
| 6,613,446 | B1 * | 9/2003 | Peters et al. | 428/593 |
| 6,643,928 | B2 * | 11/2003 | Hardesty et al. | 29/890 |
| 6,732,432 | B2 * | 5/2004 | Foster et al. | 29/890 |
| 6,840,039 | B2 * | 1/2005 | Huh | 60/323 |
| 7,169,365 | B2 * | 1/2007 | Lancaster et al. | 422/179 |
| 7,179,431 | B2 * | 2/2007 | Lesher et al. | 422/180 |
| 2002/0172626 | A1 | 11/2002 | Lesher et al. | |
| 2003/0121252 | A1 | 7/2003 | Huh | |
| 2003/0159414 | A1 | 8/2003 | Cheng et al. | |
| 2003/0211020 | A1 | 11/2003 | Rao et al. | |

FOREIGN PATENT DOCUMENTS

JP A-2002-227643 8/2002

* cited by examiner

*Primary Examiner*—Binh Q Tran
(74) *Attorney, Agent, or Firm*—Oliff & Berridge, PLC

(57) ABSTRACT

An exhaust pipe 1 having a circular cross section is connected to a circular cylindrical housing 2 which creates part of pipe conduit. The housing 2 forms a storage space 21 having a diameter larger than the diameter of the exhaust pipe 1 and connecting to the rear connection part 22. The connection part 22 is tapered toward the downstream exhaust pipe 12 and the diameter of the connection part 22 is gradually reduced and its opening is welded into the opening of the downstream exhaust pipe 12. And a cylindrical honeycomb catalyst carrier 3 is stored in the storage space 21 so that the outer surface of the catalyst carrier is in contact with the inner surface of the storage space 21. An expanded portion 23 having a diameter larger than the diameter of the storage space 21 is outwardly expanded from the outer circumference of the housing 2 and connectingly provided on the front face of the storage space 21. The diameter of the expanded portion 23 is gradually reduced toward the upstream exhaust pipe 11 and welded into the opening of the outer wall of the exhaust pipe 11.

2 Claims, 3 Drawing Sheets

EXHAUST PIPE OF VEHICLE

BACKGROUND OF THE INVENTION

1. Field of the Invention

This invention relates to an exhaust pipe of vehicle (hereinafter referred to as "vehicle exhaust pipe"), especially the exhaust pipe incorporating a space to store a catalyst carrier for purifying the exhaust emissions.

2. Description of the Related Art

FIGS. 4 and 5 respectively show an example of the conventional vehicle exhaust pipe. FIG. 4 is a vertical cross-sectional view of the conventional exhaust pipe. FIG. 5 shows a cross-sectional view of the conventional exhaust pipe. As shown in each drawing, a circular cylindrical housing 2 is connected to the exhaust pipe 1 having a circular cross section so that part of the pipe conduit is formed. The circular cylindrical housing 2 forms a storage space 21 having a diameter larger than the diameter of the exhaust pipe 1 therein the connection parts 26, 27 respectively provided on the both ends of the storage space 21 are gradually tapered and connected to the exhaust pipes 11 and 12 respectively. Each opening of the connection parts 26, 27 is connected to an opening of the upstream exhaust pipe 11 and the downstream exhaust pipe 12 respectively. A known honeycomb catalyst carrier 3 is stored in the storage space 21 so that the outer surface of the catalyst carrier is in contact with the inner surface of the storage space 21.

Japanese patent publication laid-open No. 2002-227643 teaches that one exhaust pipe is inserted and connected to the other exhaust pipe by tightening the bracket with bolts and nuts.

In the above conventional exhaust pipe, the diameter of the storage space 21 is larger than that of the exhaust pipe 1 so that the flow velocity of the exhaust gas through the catalyst carrier 3 can be sufficiently reduced, thus, the exhaust emissions can be surely purified through the catalyst supported in the catalyst carrier 3. However, the inventor in the present invention conducted an experiment and learned the fact that when the flow velocity of the exhaust gas in the upstream pipe 11 increases, the exhaust gas is not sufficiently diffused in the connection part 26 and most of the exhaust gas flow only near the center of the storage space 21 as indicated by a dotted circle line in FIG. 5 extending from the exhaust pipe 1. In other words, the flow velocity of the exhaust gas through the catalyst carrier 3 is not sufficiently reduced and the catalyst secured in the peripheral area of the catalyst carrier 3 hardly functions as an exhaust gas purifier. Therefore, the exhaust gas purification is not appropriately done in the conventional exhaust pipe system.

SUMMARY OF THE INVENTION

An object of this invention is to provide a vehicle exhaust pipe which can sufficiently purify the exhaust gas even if the flow velocity of the exhaust gas in the exhaust pipe is increased.

To achieve the above object, the exhaust pipe proposed in this invention is a vehicle exhaust pipe forming a storage space incorporating the catalyst carrier which is provided on a mid area of its pipe conduit, and an expanded portions with a diameter at least partly larger than the diameter of the storage space, which is provided on at least one side of a front side and a rear side of the pipe conduit.

In this invention, when the expanded portion is connectingly provided on the front side of the storage space, a sufficient amount of the exhaust gas which flows into the expanded portion is fully diffused while the flow velocity is decreasing therein, since the expanded portion has a cross sectional area larger than that of the storage space. And then the flow of the exhaust gas in the expanded portion is narrowed down into the storage space. Thus, the exhaust gas flows almost evenly into the inner and outer circumferences of the catalyst carrier in the storage space with the appropriate velocity so that the exhaust gas can sufficiently be purified. On the other hand, when the expanded portion is connectingly provided on the rear side of the storage space, the decreased flow velocity and diffusion of the exhaust gas in the expanded portion affect the function of the upstream storage space. Thus, the exhaust gas flows almost evenly into the inner and outer circumferences of the catalyst carrier in the storage space with the appropriate velocity so that the exhaust gas can sufficiently be purified.

In the present invention, the vehicle exhaust pipe can provide a sufficient purification of the exhaust gas even if the flow velocity of the exhaust gas in the exhaust pipe increases.

DETAILED DESCRIPTION OF THE PREFERRED EMBODIMENTS

Embodiment 1

Figure 1:
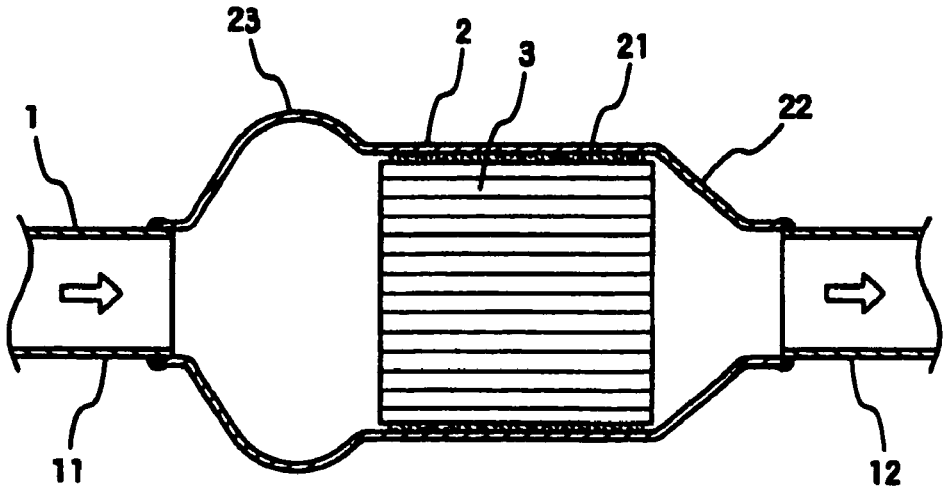
FIG. 1 is a vertical cross sectional view of an exhaust pipe connected to a housing of Embodiment 1 in this invention.

FIG. 1 shows a vertical cross-sectional view of the exhaust pipe connected to a housing. More precisely, in FIG. 1, a circular cylindrical housing 2 formed by a spinning process or the like connects to the exhaust pipe having a circular cross section, so that part of the pipe conduit can be created. The housing 2 forms a storage space 21 having a diameter larger than the diameter of the exhaust pipe 1 and connecting to the rear connection part 22. The connection part 22 is tapered toward the downstream exhaust pipe 12 and the diameter of the connection part 22 is gradually reduced and its opening is welded into the opening of the downstream exhaust pipe 12. And a known circular cylindrical honeycomb catalyst carrier 3 is stored in the storage space 21 so that the outer surface of the catalyst carrier 3 is in contact with the inner surface of the storage space 21.

In Embodiment 1, an expanded portion 23 having a diameter larger than the diameter of the storage space 21 is outwardly expanded from the outer circumference of the housing 2 and connectingly provided on the front face of the storage space 21. The diameter of the expanded portion 23 is gradually reduced toward the upstream exhaust pipe 11 and welded into the opening of the outer wall of the exhaust pipe 11

By providing the expanded portion 23 on the front face of the storage space 21, the velocity of the exhaust gas (indicated by a white arrow in FIG. 1) which flows into the housing 2 via the upstream exhaust pipe 11 decreases in the expanded portion 23 having a cross-sectional area larger than that of the storage space 21. The exhaust gas is fully diffused in the expanded portion 23 and then the flow of the exhaust gas is narrowed down into the storage space 21. Thus, the exhaust gas flows almost evenly into the entire end face of the catalyst carrier 3 in the storage space 21 with the appropriate velocity so that the exhaust gas can sufficiently be purified through the catalyst secured on the inner and outer circumference of the catalyst carrier 3.

Embodiment 2

In this Embodiment, a connection part 24 having a diameter which is gradually reduced and tapered down toward the upstream exhaust pipe 11 is formed on the front face of the storage space 21 of the housing 2, and the opening of the connection part 24 is welded into the opening of the upstream exhaust pipe 11. An expanded portion 25 having the same structure as the expanded portion described in Embodiment 1 is connectingly formed on the rear side of the storage space 21, and the opening of the expanded portion 25 is welded into the opening of the downstream exhaust pipe 12.

Figure 2:
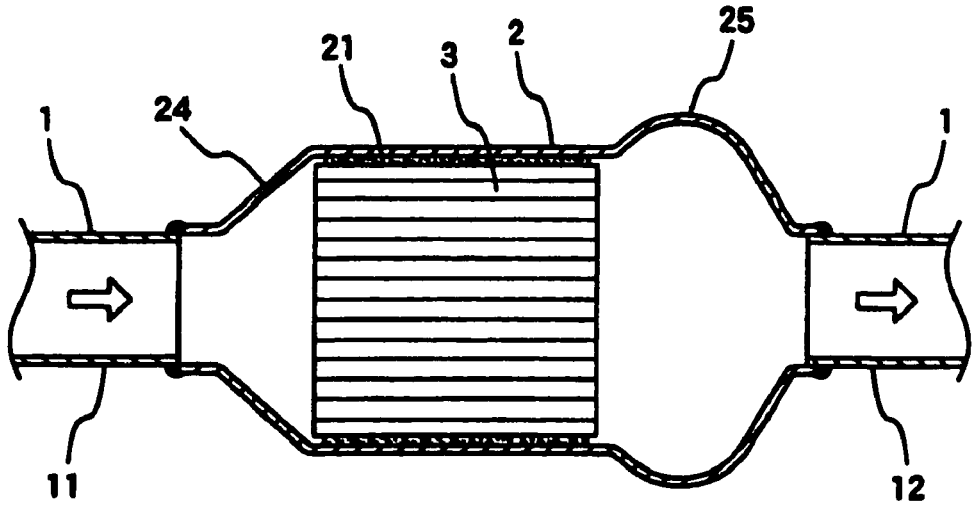
FIG. 2 is a vertical cross sectional view of an exhaust pipe connected to a housing of Embodiment 2 in this invention.

By providing the expanded portion 25 on the rear face of the storage space 21, a decrease in flow velocity and the diffusion of the exhaust gas (indicated by a white arrow in FIG. 2) in the expanded portion affect the upstream storage space 21. Thus, the exhaust gas flows almost evenly into the inner and outer circumferences of the catalyst carrier 3 in the storage space 21 with the appropriate velocity so that the exhaust gas can sufficiently be purified.

Embodiment 3

Figure 3:
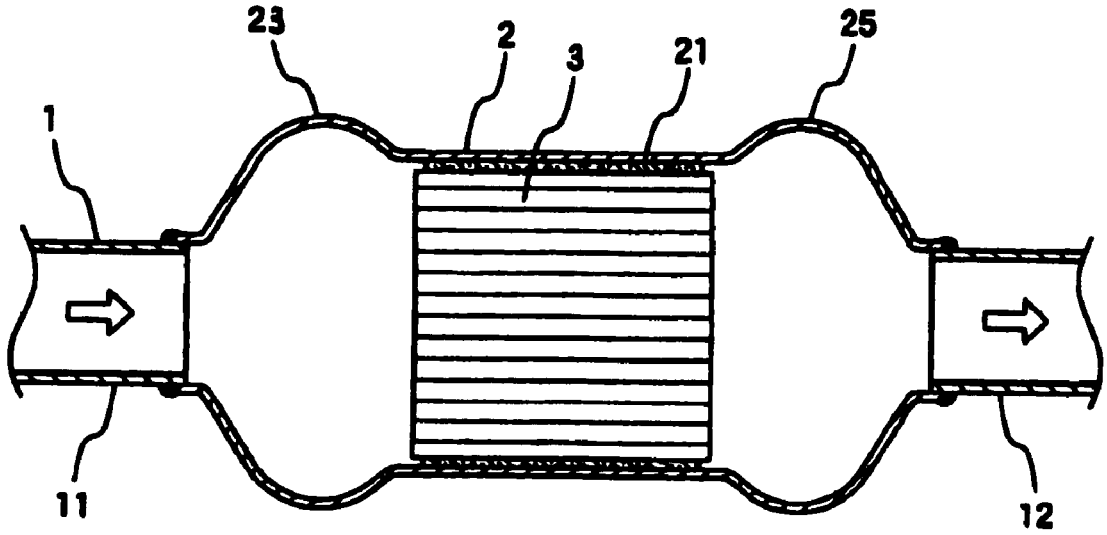
FIG. 3 is a vertical cross sectional view of an exhaust pipe connected to a housing of Embodiment 3 in this invention.
Figure 4:
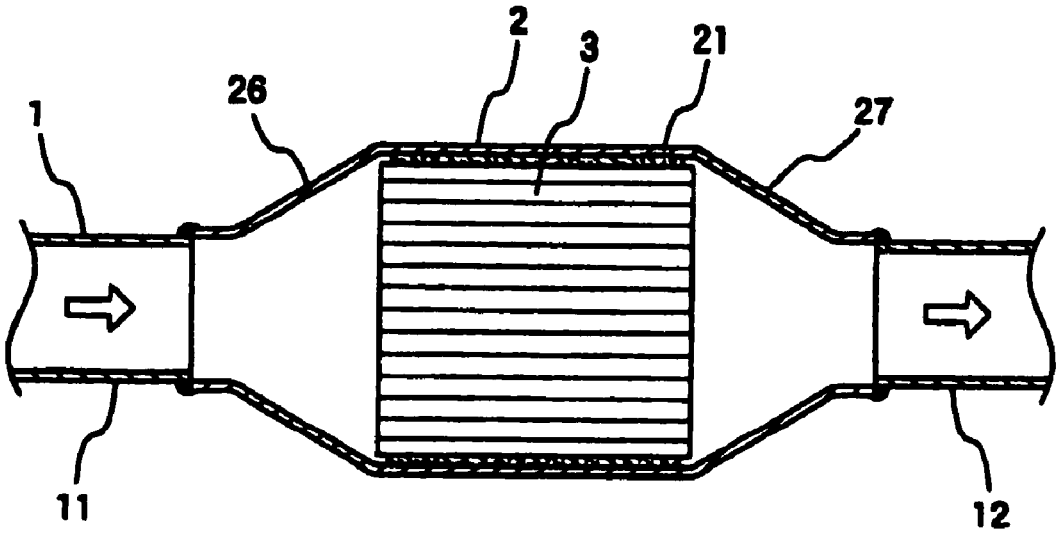
FIG. 4 is a vertical cross sectional view of an exhaust pipe connected to a housing of the conventional invention.
Figure 5:
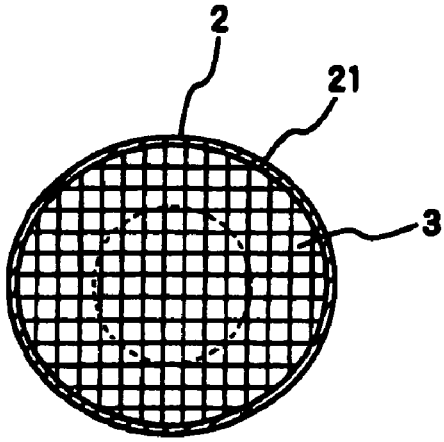
FIG. 5 is a cross sectional view of the V-V line described in FIG. 4.

As shown in FIG. 3, the expanded portions 23, 25 are respectively provided on the front face and rear face of the storage space 21 of the housing 2 so that the exhaust gas can be purified more effectively by synergetic effect of Embodiments 1 and 2.

Other Embodiments

The opening edge of the expanded portions 23, 25 respectively connected to the exhaust pipe 1 is formed so as to create a continuous curved surface. Thus, the exhaust gas can smoothly flow into the expanded portion 23 or flows out of the expanded portion 25. Furthermore, the diameter of the entire circumference of the expanded portion 23, 25 is not necessarily larger than the diameter of the storage space 21. In other words, the diameter of the expanded portions 23, 25 can only be partially larger than that of the storage space 21.

What is claimed is:

1. An exhaust pipe of a vehicle, the exhaust pipe comprising:

a storage space incorporating a catalyst carrier which is provided on a mid area of an exhaust pipe conduit; and an expanded portion, one end of the expanded portion connected to a single upstream pipe of the exhaust pipe and the other end of the expanded portion connected to the storage space, at least a part of the expanded portion having a diameter larger than a diameter of the storage space, the expanded portion provided on at least one of an upstream side and a downstream side of the exhaust pipe conduit, wherein the expanded portion comprises a circular cross-section cylindrical housing shaped as a protruding curve forming a gentle slope with a single peak that protrudes outwardly from the exhaust pipe, the gentle slope being gradual with no sharp changes in angle.

2. The exhaust pipe of claim 1, wherein the catalyst carrier is a cylindrical shaped body incorporating a honeycomb structure, and an outer surface of the catalyst carrier is in contact with an inner surface of the storage space.

* * * * *